US008810423B2

(12) United States Patent
Kaczmarek et al.

(10) Patent No.: US 8,810,423 B2
(45) Date of Patent: Aug. 19, 2014

(54) INTEGRATED OPERATION DISPLAY DEVICE

(75) Inventors: Wolfgang Kaczmarek, Schwindegg (DE); Gerd Wilsdorf, Olching (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 290 days.

(21) Appl. No.: 11/794,380

(22) PCT Filed: Oct. 21, 2005

(86) PCT No.: PCT/EP2005/055454

§ 371 (c)(1),
(2), (4) Date: Jun. 26, 2007

(87) PCT Pub. No.: WO2006/069832

PCT Pub. Date: Jul. 6, 2006

(65) Prior Publication Data

US 2008/0106429 A1 May 8, 2008

(30) Foreign Application Priority Data

Dec. 27, 2004 (DE) ..... 10 2004 062 752

(51) Int. Cl.
*G08B 21/00* (2006.01)
*G05B 11/01* (2006.01)
*A47L 15/42* (2006.01)

(52) U.S. Cl.
CPC ..... *A47L 15/4257* (2013.01); *A47L 15/4293* (2013.01)
USPC ..... 340/679; 700/17

(58) Field of Classification Search
USPC ..... 361/680, 825.33; 381/42; 340/679; 715/746; 700/95, 17, 83
See application file for complete search history.

(56) References Cited

U.S. PATENT DOCUMENTS

| | | | | |
|---|---|---|---|---|
| 4,418,398 | A * | 11/1983 | Hornung | 713/100 |
| 5,441,344 | A * | 8/1995 | Cook, III | 374/141 |
| 5,996,357 | A * | 12/1999 | Park | 62/125 |
| 6,408,218 | B1 * | 6/2002 | Hallahan et al. | 700/102 |
| 6,483,695 | B1 * | 11/2002 | Hartstein | 361/679.09 |
| 7,028,697 | B2 * | 4/2006 | Christman et al. | 134/115 R |
| 7,296,236 | B2 * | 11/2007 | King | 715/746 |
| 7,383,654 | B2 * | 6/2008 | Olivier et al. | 40/661.12 |
| 7,404,298 | B2 * | 7/2008 | Kim et al. | 62/126 |
| 2001/0027055 | A1 * | 10/2001 | Laity et al. | 439/490 |

(Continued)

FOREIGN PATENT DOCUMENTS

| | | |
|---|---|---|
| DE | 197 24 479 | 12/1998 |
| DE | 102 18 294 | 11/2003 |

(Continued)

OTHER PUBLICATIONS

International Search Report PCT/EP2005/055454.

*Primary Examiner* — Benjamin C Lee
*Assistant Examiner* — Sigmund Tang
(74) *Attorney, Agent, or Firm* — James E. Howard; Andre Pallapies

(57) ABSTRACT

A household appliance is provided in the configuration of a dishwasher having a door, a control unit for controlling the household appliance, and an operation display device for displaying at least one operation state of the household appliance. The operation display device is provided with a large surface and displays the following operation states: operation, end of program and stop, respectively, on the entire surface thereof.

14 Claims, 2 Drawing Sheets

(56) References Cited

U.S. PATENT DOCUMENTS

Figure 1:
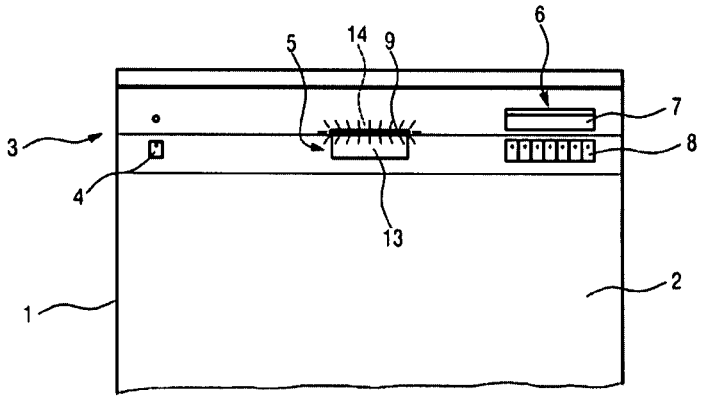

| | | | | |
|---|---|---|---|---|
| 2003/0025733 | A1* | 2/2003 | Broker et al. | 345/765 |
| 2003/0209018 | A1 | 11/2003 | Becke et al. | |
| 2006/0232997 | A1 | 10/2006 | Rosenbauer et al. | |
| 2007/0273475 | A9* | 11/2007 | Neumann | 340/5.52 |
| 2008/0106429 | A1* | 5/2008 | Kaczmarek et al. | 340/679 |
| 2008/0265131 | A1* | 10/2008 | Tsai | 250/206 |

FOREIGN PATENT DOCUMENTS

| | | |
|---|---|---|
| DE | 203 16 158 U | 12/2003 |
| EP | 0 691 100 | 1/1996 |
| EP | 1 151 717 | 11/2001 |
| EP | 1 321 090 | 6/2003 |
| EP | 1 421 893 | 5/2004 |
| WO | WO 2004/057636 | 7/2004 |

* cited by examiner

INTEGRATED OPERATION DISPLAY DEVICE

The invention relates to a household appliance, in particular a dishwashing machine, having an appliance door, having a control unit for the control of the household appliance, and having a status indicator for the reproduction of at least one operating state of the household appliance.

DE 197 24 479 A1 discloses a program sequence indicator on a household appliance where individual program steps are represented on a program template arranged on the appliance and where the program step currently running is marked by a light signal initiated by the sequence control system of the appliance. With this indicator the aim is to achieve a plurality of display possibilities. This aim is achieved through the sequence indicator incorporating a light source which, when activated accordingly, emits light in different colors, and which is arranged behind a translucent panel to which the program template is applied. Thus, the individual program steps on the program template are displayed in color according to the color of the light emitted by the light source for the program step running in the appliance at the time.

If users wish to know only whether they can empty the appliance, that is to say whether the appliance has already finished its operating program or whether it is still running, they have to establish this from the, often extensive, prior art indicators. This can be done only by taking a closer look or with a precise knowledge of the meaning of the indicators. DE 100 22 206 C2 also discloses a dishwashing machine, in particular a built-in dishwashing machine with a pivotable appliance door which has, on its upper end face, a visual status indicator with one or more light sources. When the appliance door is closed, the light sources are covered by a countertop which rests on the top of the dishwashing machine. Fixedly positioned in the gap between the appliance door and the underside of the covering countertop is a light guide which directs the signal light of the covered visual status indicator to the front face of the appliance. The light guide is connected to a vapor protection element fixedly positioned on the underside of the countertop above the appliance door and is held in positive and/or non-positive engagement in a material cutout of this element in a frame component. The frame component is correctly positioned for the light guide of the vapor protection element by means of a template, and the template used for the frame component is the vapor protection element itself. Thus this document describes a dishwashing machine where the entire surface area of the appliance door is free from control elements and status indicators and where only a handle element disturbs the planar visual appearance of the front of the appliance. With a dishwashing machine of this kind, however, the gap in which to reproduce information on the operating state of the dishwashing machine, between the upper end face of the appliance door and the countertop, is only narrow. Furthermore, the aim is generally to keep these and other gaps as small as possible. The gap is also difficult to inspect since countertops are generally arranged so as to project distinctly beyond the units installed under them.

The object of the invention is therefore to provide a household appliance in which the status indicator is easy to see and reproduces approximate information concerning the operating state of the household appliance in a quickly detectable manner.

This object is achieved in a household appliance of the kind referred to in the introduction in that the status indicator has a large surface area, the whole of which displays one of the operating states "Running", "Program end" and "Off". The invention thus puts into effect the principle of providing a small amount of information, but the vital information, quickly. This enables users to detect the operating state of the household appliance with just a quick glance, even from some distance, instead of having to approach the appliance and, from a large amount of information, establish that the appliance is still running and thus cannot yet be unloaded—which is what they have had to do until now.

To enable the approximate information to be detected even from a relatively large distance, the status indicator has a large surface area. Here the phrase "large surface area" is intended to mean a surface area which is distinctly beyond the extent of individual symbols or luminous spots of status indicators known, for example, for ON/OFF indicators, for example one that is at least twice as large. Its planar layout is naturally very dependent on the design required. As a linear status indicator, for example, it can extend over the whole width of the appliance door. As a planar element, it can occupy the surface area corresponding to a handle shell on the appliance door or the surface area corresponding to a program sequence indicator as defined in the above-cited prior art. In any event, its surface area should be larger than that of the indicator areas or illuminated areas of previous indicators, which have conventionally been of approximately fingernail size.

Numerous different principles can be applied to achieve a status indicator. In the case of mechanical status indicators a movable pointer, for example, indicates the relevant operating state on a scale which is, for example, linear or circular. In the case of electronic indicators it is known to produce the pointer on a display or to indicate the operating state on the display itself by the reproduction of words or by the illumination or backlighting of symbols, as disclosed in DE 203 16 158 U1. Simpler status indicators such as those described in DE 100 22 206 C2, for example, merely provide approximate information regarding the end of the operation process of the household appliance by means of a light signal. For the invention it has proved to be advantageous for the status indicator to comprise a light-emitting element. Here the term "light-emitting element" is intended to mean any device capable of emitting light using current. In the present case, LED technology is particularly suitable for this purpose—also in conjunction with light guides—because this technology requires only a small amount of space, can be designed to be extremely inconspicuous in the idle state and yet is readily detectable in an operating state owing to the large amount of light emitted in proportion to its size. By contrast with the other above-mentioned principles, light-emitting elements generally have the advantage of being perfectly detectable both when there is adequate illumination and also, or more so, when illumination is poor.

It is possible to signal different operating states even with a single light-emitting element. According to the invention, one light-emitting element displays different operating states by means of different illumination states, namely by means of continuous and flashing light, by means of different luminosities or by means of different flashing frequencies. Thus, for example, when the dishwashing machine is in an idle state, a light-emitting element can also be switched off and can flash when the household appliance is running. The flashing light can also have a warning function, to indicate to users that they should not interfere with the household appliance program sequence, for example by opening the appliance door. Lastly, when the light-emitting element emits a continuous light, this can indicate the end of the program and can signal to the user that the dishwashing machine can be unloaded.

According to a development of the invention alternative to the foregoing, it is possible to provide a light-emitting element which displays different operating states by means of different-colored light. Here again, a switched-off light-emitting element could indicate that the appliance is idle, a red light could indicate that the appliance is running and, lastly, a green light could indicate that the program has finished and that the appliance can be unloaded. LEDs are suitable light-emitting elements which emit light of different colors. Of course, it is also possible to combine a plurality of light-emitting elements, each emitting light of only one color but with a different color configuration, in a common status indicator. Other technologies, for example those where a common light guide is irradiated, are also suitable for this purpose. This embodiment is not restricted to just one LED as light-emitting element but can also encompass a plurality of LEDs with a plurality of different colors. Furthermore, operating states can also be indicated by the flashing of the light-emitting element at, preferably, different frequencies.

The status indicator can in principle be arranged on the front of the appliance door in any place where a user can still easily see it even from a relatively long distance. According to an advantageous embodiment of the invention, the status indicator is integrated in the handle element. Here integration of the status indicator in the handle element is intended to mean any arrangement providing a connection between the status indicator and the handle element and, at the same time, not extending beyond the faces which are in any case required for the purpose of securing the handle element to the appliance door front. Handle elements can, for example, be in the form of stirrup grips, handle shells, handle strips or knobs. The invention thus leads away from a separate arrangement and design of the status indicator and pursues the concept of using, for a status indicator, visual interruptions that are in any case provided on the appliance front. For this purpose the invention proposes that the functions of the status indicator and of the handle element be combined in one component. On the one hand therefore, according to the invention the status indicator is arranged in a prominent place which a user can readily see at any time. On the other hand, according to the invention the appliance door area of view need not be interrupted by the arrangement of the status indicator.

According to the invention, any handle elements that offer the largest possible area of view can be advantageously used. A stirrup grip, handle strip or handle shell can therefore be advantageously used as a handle element. Status indicators according to the invention can be usefully accommodated in the areas of view facing a user. In principle, this is also possible in handle elements in knob form; these must have a surface area that is still of an adequate size so that the status indicators can still be recognized as such.

The status indicators should be creatively integrated in the handle element in such a way that the visual appearance of the element is not unnecessarily impaired. According to an advantageous development of the invention therefore, the light-emitting element acting as a status indicator is admitted into a depression in the handle element. A depression of this kind, preferably linear, is in any event often provided in the form of grooves or beads on elongated handle elements such as stirrup grips or handle strips for design reasons. It is therefore possible to accommodate therein preferably LEDs or light guides which co-operate with LEDs, these being visually inconspicuous when not in operation.

According to an advantageous development of the invention alternative to the foregoing, the handle element is made from a transparent material such as Perspex, which surrounds the light-emitting element. The light-emitting element is thus cast in the handle element and therefore illuminates the handle element from inside wholly or only in part. This creates both a large emission area for the light-emitting element and an attractive visual design.

According to a further alternative embodiment of the invention, the status indicator is accommodated in a shell-shaped handle element. A handle element of this kind has a panel approximately in the plane of the appliance door surface and a recessed depression disposed therebehind. Engagement in the depression makes it possible to grip behind the panel, so that the appliance door can thereby be pulled open. Since the panel is generally gripped from behind with four fingers, the depression in the handle shell extends approximately the width of a hand in a horizontal direction. The light-emitting element of the status indicator can preferably be arranged in the panel or behind it. In the latter case, the depression can be provided with a rounding, so that it acts as a reflector for the light emitted by the light-emitting element. This provides a status indicator which is visible only in operation and then only indirectly; this can be an advantage in terms of design.

A status indicator according to the invention, in particular in the form of a light-emitting element, reproduces only approximate information. Further details concerning the program status or program sequence are generally indicated in a display. The term "display" in this sense is intended to mean both a typical program sequence indicator, for example in a conventional, linear or circular scale design, or an LCD display or screen display. According to an advantageous embodiment of the invention, the status indicator is in the form of the illumination of a display. This inventive arrangement utilizes, for the status indicator, the surface area that is in any case present on the display, and it thus reduces the surface area required on the front of the appliance door for technical control devices.

For design reasons it is desirable to provide dishwashing machines, in particular, with an appliance door which has a surface adapted to the other kitchen units. For this purpose it has recently become the practice to produce and use what are known as fully integrated dishwashing machines; these have neither control units nor status indicators on the front face of the appliance door. They just have a handle for operating the appliance door and are thus barely distinguishable from the fronts of the other kitchen units. The control elements of the dishwashing machine are then accommodated in an end face of the appliance door, and a user sees and has access to this face only on opening the appliance door.

Nevertheless, here too an indicator of the operating state or progress of the dishwashing machine is desirable so that the user knows when the washing operation is finished. The user will thus have access to the washed dishes all the sooner. An indicator also prevents the user from inadvertently interrupting the dishwashing process by opening the appliance door. There is an even greater risk of this now, given that present-day dishwashers are very quiet and their noise level is also diminished by the presence of a fascia over the front of the appliance door. According to a further advantageous development of the invention, a household appliance with a concealed control unit has a status indicator integrated in a handle element in one of the previously described developments. Thus, a status indicator can be integrated in the front of an appliance door without the design of the appliance door having to differ from that of the other kitchen units.

According to an embodiment of the invention alternative to the foregoing, a status indicator is arranged in an upper end face of the appliance door. This also enables the visual effect described above to be achieved, but without the need to provide a special handle. As a result of the arrangement in the upper end face, the gap above the appliance door is illuminated and thus the desired information is provided. This arrangement is therefore recommended in particular for built-in machines, where the gap above the appliance door is not largely covered by a countertop.

Figure 2:
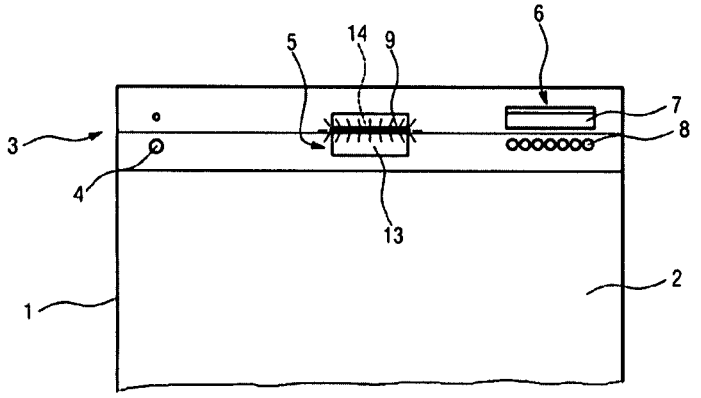
Figure 3:
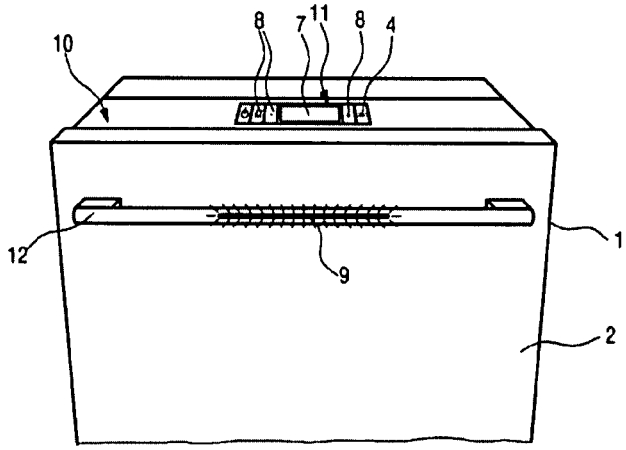
Figure 4:
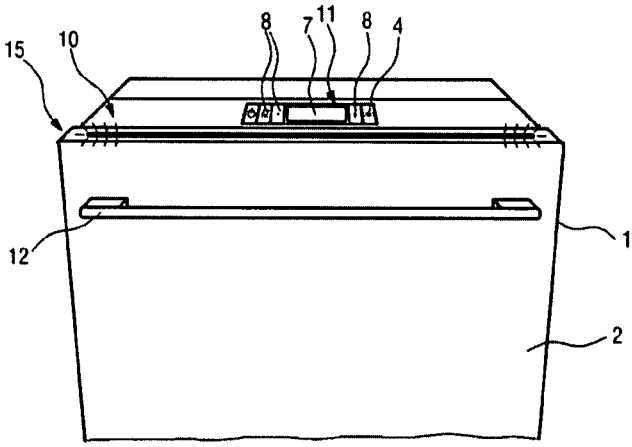

The principle of the invention is explained in further detail below with reference to the drawings, in which FIG. 1 shows: an upper portion of an appliance door of a freestanding dishwasher, FIG. 2 shows: an upper portion of an appliance door of a built-in dishwasher, FIG. 3 shows: a perspective drawing of an upper section of an appliance door of a fully integrated dishwasher, and FIG. 4 shows: a perspective drawing of an upper section of an alternative appliance door of a fully integrated dishwasher.

FIG. 1 shows a front view of an appliance door 1 of a "freestanding" dishwasher. The area of interest on this dishwasher does not differ substantially from that of a built-in dishwasher, a cutaway portion of the appliance door of which is shown in FIG. 2. The two figures are therefore described together in the following. The appliance door 1 has, above a front 2, the surface of which has the same design as the fronts of the other kitchen units, a control panel 3. The surface area of the panel is divided essentially into three sections. In the left-hand section there is arranged a start button 4 for switching the dishwashing machine on and off. In its central section the control panel 3 has a handle element 5 for opening and closing the appliance door 1. In its right-hand section there is arranged, in the control panel 3, a control unit 6 which is divided into a display 7 and a number of switches 8. The dishwashing machine operating program can be pre-selected using the switches 8, and the program is then indicated in the display 7. The display 7 also provides information on the section of the program currently running on the dishwashing machine. This information can be provided by means of either numbers, symbols or graphical representations such as bar charts. To obtain this information, however, the user has to come close to the dishwashing machine to be able to read correctly from the display the information reproduced there.

For the reproduction of the information as to whether the machine is still running or whether it has finished the program there is provided a light-emitting strip 9 integrated as a status indicator in the handle element 5. This strip is located above a depression 13, which acts as an engagement for the user. By means of the depression the user can grip behind a panel 14 which, in FIG. 1, is part of the control panel 3 and, in FIG. 2, is designed separately. The light-emitting strip 9 is arranged in the panel 14 and therefore centrally on the front of the appliance door 1. Thus, the strip is always associated with the relevant dishwasher; in other words, it cannot inadvertently, e.g. in an unlit kitchen, be associated with an appliance alongside the dishwasher.

The light-emitting strip 9 can be controlled in three ways: without a power supply, that is to say switched off, it indicates that the appliance is idle; if it flashes (or if the light is red), this signals that the dishwashing machine is running, so during this time the user should not open the appliance door 1; and if there is a continuous light (or a green light), this indicates that the washing program is finished, so the user can open the dishwashing machine and empty it. Of course, the information signaled by the continuous light and flashing light can also be in reverse. Alternatively, the light-emitting strip can generate two colors so that when the dishwashing program is finished, the light does not flash but is illuminated in a different color.

FIG. 3 shows a partial perspective drawing of an appliance door 1 of what is known as a fully integrated dishwasher. Since, in this case, the intention is to prevent the visual impairment of the front 2 by a control element, a control unit 11 is arranged on an upper end face 10 of the appliance door 1. When the appliance door is closed, the end face 10 is covered by a countertop or by a kitchen unit located thereover, as a result of which the control unit 6 is visible and accessible to the user only when the appliance door 1 is opened. The front 2 of the appliance door 1 has only a handle element 12, which is in the form of a stirrup grip. To provide the user nevertheless with at least approximate information concerning the operating state of the dishwasher, a bar-shaped lamp is integrated in the handle element 12 as a status indicator 9. As in the previous embodiment in FIGS. 1 and 2, the status indicator indicates the operating state of the dishwasher by means of continuous or flashing light. Since the status indicator is integrated in the handle element 12, it does not require any additional surface area on the front 2. The status indicator does not therefore disturb the uniform visual appearance of the appliance door 1, which does not therefore differ appreciably from the other kitchen units.

A further embodiment is shown in FIG. 4. This figure also shows a partial perspective view of an appliance door 1, similar to that in FIG. 3. By contrast with the appliance door shown in FIG. 3, however, the status indicator 9 here is arranged not in the handle element 12 but in a forward section 15 of the upper end face 10 of the appliance door. The advantage of this is that, for this embodiment, there is no need to use a separately designed handle element 12. Instead, it is possible to use a handle element such as is also used on the other kitchen units. The user now has no direct view of the status indicator 9 but obtains information on the operating state of the dishwashing machine by virtue of the fact that the gap above the appliance door 1 is, where appropriate, illuminated over the whole width of the dishwashing machine. This arrangement is therefore preferable for built-in appliances since no countertop is arranged above these machines, restricting the user's view of the gap. In a further embodiment (not shown) the status indicator can also be fitted in at least one side face of the appliance door. Thus either one or both side gaps are illuminated, or all three gaps are illuminated.

The invention claimed is:

1. A dishwashing machine, comprising:

a housing with an opening on the front thereof;

a door that covers the opening on the front of the housing, the door comprising a front wall, a rear wall, a top wall, a bottom wall and right and left sidewalls;

a handle located adjacent the top of the front wall of the door, the handle comprising a panel with a depression there within for receiving a user's hand; and a light emitting element that emits light to indicate an operational condition of the dishwashing machine, the light emitting element being located on a rear surface of the panel of the handle such that the light emitting element is not directly visible from a front of the dishwasher, and such that light emitted from the light emitting element is reflected off the depression.

2. The dishwashing machine as claimed in claim 1, wherein the light emitting element emits different colors of light to indicate corresponding different operational conditions of the dishwasher.

3. The dishwashing machine as claimed in claim 1, wherein the light emitting element emits a flashing light when the dishwashing machine is running, continuous light after a cleaning operation has been completed, and no light when the dishwashing machine is off.

4. The dishwashing machine as claimed in claim 1, wherein the lighting element emits a display selected from the group consisting of a continuous light and a flashing light of different flashing frequencies.

5. The dishwashing machine as claimed in claim 1, wherein the light emitting element is an LED.

6. The dishwashing machine as claimed in claim 1, wherein no user inputs are visible when the door is closed.

7. The dishwashing machine as claimed in claim 1, wherein all user inputs are located on a top surface of the door and the top surface is adapted to be concealed when the dishwasher is installed and the door is closed.

8. A dishwashing machine, comprising:

a housing with an opening on the front thereof;

a door that covers the opening on the front of the housing;

a handle comprising a panel with a depression for receiving a user's hand; and a light emitting element that emits light to indicate an operational condition of the dishwashing machine, the light emitting element being located such that the light emitting element is not directly visible from a front of the dishwasher, and such that light emitted from the light emitting element is reflected off the depression.

9. The dishwashing machine as claimed in claim 8, wherein the light emitting element emits different colors of light to indicate corresponding different operational conditions of the dishwasher.

10. The dishwashing machine as claimed in claim 8, wherein the light emitting element emits a flashing light when the dishwashing machine is running, continuous light after a cleaning operation has been completed, and no light when the dishwashing machine is off.

11. The dishwashing machine as claimed in claim 8, wherein the lighting element emits a display selected from the group consisting of a continuous light and a flashing light of different flashing frequencies.

12. The dishwashing machine as claimed in claim 8, wherein the light emitting element is an LED.

13. The dishwashing machine as claimed in claim 8, wherein no user inputs are visible when the door is closed.

14. The dishwashing machine as claimed in claim 8, wherein all user inputs are located on a top surface of the door and the top surface is adapted to be concealed when the dishwasher is installed and the door is closed.

* * * * *